US005377563A

United States Patent [19]

Weeks

[11] Patent Number: 5,377,563

[45] Date of Patent: Jan. 3, 1995

[54] KNIFE SHARPENER

[76] Inventor: Raymond Weeks, 353 Washington St., Mt. Holly, N.J. 08060

[21] Appl. No.: 85,072

[22] Filed: Jul. 2, 1993

[51] Int. Cl.[6] ..... B21H 1/02

[52] U.S. Cl. ..... 76/86; 451/545

[58] Field of Search ..... 76/86, 87, 82; 51/214, 51/211 R

[56] References Cited

U.S. PATENT DOCUMENTS

| | | | |
|---|---|---|---|
| 455,917 | 7/1891 | Blood | 76/87 |
| 521,755 | 6/1894 | Birch | 76/87 |
| 530,613 | 12/1894 | Berkman | 76/86 |
| 1,255,760 | 2/1918 | Kirlin | 76/86 |
| 1,622,197 | 3/1927 | Keezer et al. | 76/86 |
| 4,731,957 | 3/1988 | Weisinger | 76/86 |
| 5,046,385 | 9/1991 | Cozzini | 76/86 |

FOREIGN PATENT DOCUMENTS

| | | | |
|---|---|---|---|
| 0570341 | 2/1933 | Germany | 76/87 |

*Primary Examiner*—James G. Smith
*Attorney, Agent, or Firm*—Norman E. Lehrer

[57] ABSTRACT

A knife sharpener having a specially configured sharpening groove for sharpening knives or the like to a particularly narrow and sharp edge. The sharpener comprises a body member having a rectangular extension which has a recess for engaging the sharpening blades. The body member has grooves therein for engaging support members, one of which acts as a guard from the knife sharpening activity. A second embodiment includes the supports being angled so as to place the knife sharpener at an angle for easy access thereto. The blades are substantially triangular in shape wherein the corners of each blade are rounded, all having equivalently-sized radii. The blades are detachably attached to the body member within the recess so that the blades can be rotated or flipped for exposing additional and fresh sharpening edges. The recess is shaped so as to secure the blades in an abutting fashion wherein the bottom of each blade is angled from the horizontal and the sharpening groove between the blades is relatively narrow. Because of the rounded edges of the blades, a special sharpening groove is formed wherein the straight edge of each blade forming the groove transforms into an arc which leads to a point. Accordingly, a very narrow and sharp knife edge is formed from this groove arrangement.

8 Claims, 2 Drawing Sheets

KNIFE SHARPENER

BACKGROUND OF THE INVENTION

This invention is directed toward knife sharpeners, and more particularly, toward an improved sharpening blade configuration for forming a sharper cutting edge on a knife or the like.

Many knife sharpeners have been developed over the years that are directed toward new and improved methods for sharpening a knife edge. The numerous sharpeners include different configurations for blade shapes, blades having a plurality of sharpening edges wherein the blades are adapted to be moved or the like for exposing new edges, and supports and combined tools directed toward more conveniently placing the sharpening blades in position for use. The blade configurations include circular cutting blades, triangular cutting blades and square or rectangular cutting blades. Supports and the like include those which can be permanently attached to a work bench or the like, those which can be hand held and others which are self-supportive. In addition, tools have been invented which combine a knife sharpener with another tool such as a file or screwdriver.

U.S. Pat. No. 469,615 to Wardwell discloses a knife sharpener having abutting circular blades lying in the same vertical plane. The knife sharpener includes a support base which is adapted to attach to a permanent structure. While the Wardwell sharpener would seem to apply a circular and narrow configuration to the edge being sharpened, because of the large radius inherent in circular disks, the lead-in groove is relatively large, forming only a broad based edge having a sharp point.

U.S. Pat. No. 584,933 to Friedrich discloses a sharpener having square and rotatably attached overlapping sharpening blades also having bevelled edges. The blades in the Friedrich sharpener overlap, using the overlapping configuration to apply pressure to the knife edge being passed through the blades. The blades are rotatably attached and have a plurality of sharpening edges thereon so that the blades can be rotated to expose a fresh sharpening edge when others become dull. The sharpener in Friedrich, however, does not have rounded intersections or corners or the like which give to the knife edge, a rounded and more streamlined configuration. Additionally, the Friedrich blades, being of the overlapping nature, are in conflict with the general principles of this invention.

The patent to Keezer et al., U.S. Pat. No. 1,622,197, discloses a knife sharpener having a support and base for attachment to a permanent structure. The blades therein are elongated and triangularly shaped and are arranged to be mutually engaging. However, unlike the instant invention, the corners of the blades are not rounded and the blades engage and intersect at a point, having no lead-in radius. Therefore, again no streamlined edge is produced on the knife through sharpening the same.

In addition to the above, the patents to Jones, U.S. Pat. No. 2,436,810; Pleasants, U.S. Pat. No. 3,289,498; and Judd et al., U.S. Pat. No. 1,474,636 disclose additional knife sharpeners having circularly-shaped blades which also exhibit the same shortcomings as those patents discussed above. U.S. Pat. No. 4,731,957 to Weisinger and U.S. Pat. No. 562,223 to Hausse disclose knife sharpeners using triangular blades which are also adapted to be rotated for exposing fresh sharpening surfaces. However, and as discussed above, these blades do not exhibit rounded corners for the streamlined sharpening effect which is the purpose of this invention.

SUMMARY OF THE INVENTION

The invention of the present application is a knife sharpener having blades specially configured to provide a streamlined and comparatively sharper cutting edge to a knife or the like. The sharpener is adapted to be hand-supported or held on a sturdy surface and includes the use of two triangularly-shaped blades each having rounded corners wherein one corner from each blade is arranged in an abutting position with the other on the body member of the knife sharpener.

In accordance with the invention, the knife sharpener comprises a substantially rectangular body member having recesses for engaging the two blades having a shape similar to two equilateral triangles. In addition, the body member is adapted to engage plate-like support members for supporting and/or tilting or orientating the knife sharpener in a convenient and safe position for sharpening a knife. One of the plate-like support members also acts as a guard between the knife being sharpened and the hand of the person holding the knife sharpener body member.

The knife sharpener blades are substantially triangular in shape wherein each corner is rounded in lieu of the typical point. Each blade is of a significant thickness, having a sharpening surface on each edge comprising the triangle and on both sides comprising the blade. The triangularly-shaped blades are sized accordingly for fitting snugly into the recesses in the body member. However, the blades are attached to the body member and recesses via a screw or other removable fastening member so that the blades may be rotated or flipped to expose a fresh sharpening edge.

The most significant aspect of the present invention is the rounded corners of each triangularly-shaped blades. Also of importance is the positioning of the recesses and thereby the blades in the body member. The blades are positioned in the recesses so that the confronting edges of the triangularly-shaped blades form a relatively narrow lead-in groove or passage. The narrow groove or passage is in itself shaped like a triangle starting wide at the top and narrowing toward the bottom. When approaching the bottom, the importance of the rounded triangular corners is apparent. The rounded corners cause the narrowing groove to take on a curved shape similar to the radii of the corners. Therefore, the very tip of the groove narrows further inward on each side via the radii and forms a more streamlined sharpening groove not found with prior knife sharpeners. The advantages of the blades used in the instant invention is that a narrower and sharper cutting edge can be formed on the knife.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 1 is a perspective view of the knife sharpener showing a knife being sharpened therein with the sharpener supported on a table or the like;

DETAILED DESCRIPTION OF THE PREFERRED EMBODIMENT

Figure 1:
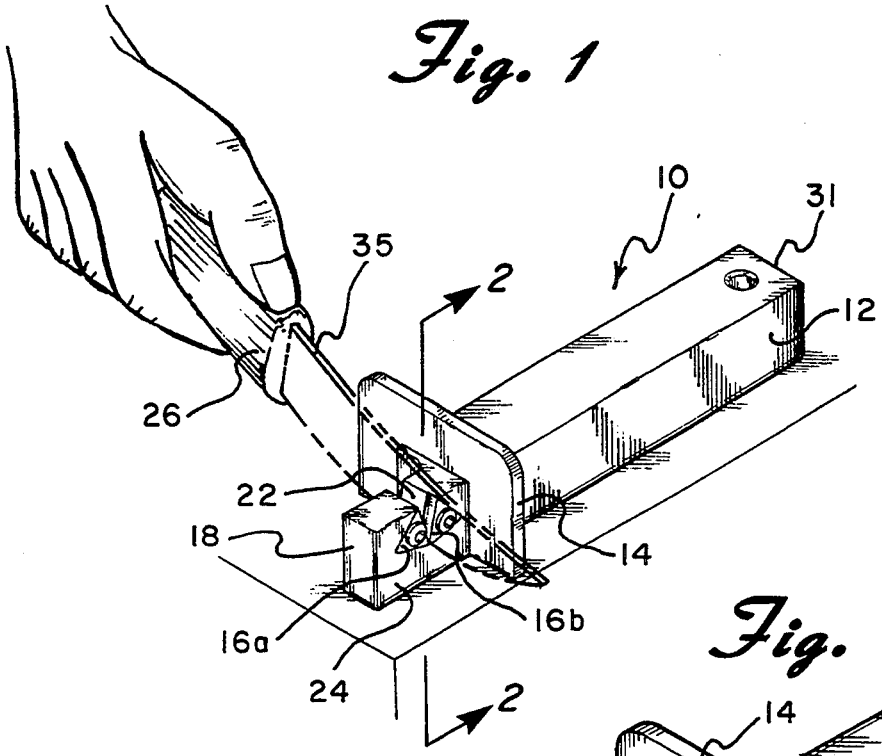

Referring now to the drawings in detail wherein like reference numerals have been used throughout the various figures to designate like elements, there is shown in FIG. 1 a perspective view of the knife sharpener constructed in accordance with the principles of the present invention and designated generally as 10. The sharpener 10 is generally comprised of the body member portion 12, the support/guard 14 and the sharpening blades 16*a* and 16*b*.

Figure 3:
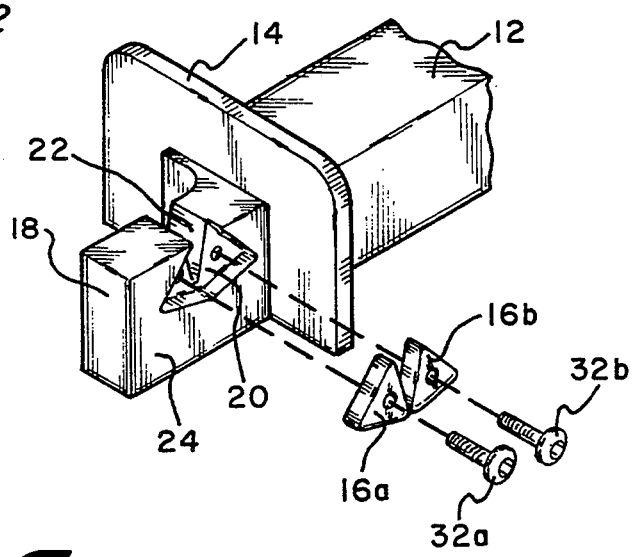
FIG. 3 is a perspective, exploded view showing the process of attaching the triangular blades to the body member.
Figure 2:
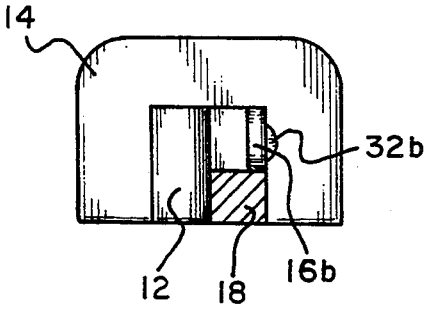
FIG. 2 is a cross-sectional view taken along line 2—2 of FIG. 1.

The body member 12 is essentially a rectangular block of material, preferably plastic, which may have holes therethrough for attachment to a table or the like, and having an additional but smaller rectangular extension 18 therefrom for housing the sharpening blades. In addition, the body member has, in a first embodiment, a groove 19 spanning a portion of its circumference for engagement with a support/guard 14, and in a second embodiment, several grooves for engagement with a support/guard and another support. As shown in FIGS. 1 and 3, the support/guard 14 is positioned on the body member 12 adjacent the additional rectangular extension 18 such that the width of the support/guard fits snugly into the groove 19. The additional rectangular extension is substantially the same height as the rest of the body member but is of lesser width. As shown best in FIG. 3, the rectangular extension 18 has a recess 20 and a guide groove 22 formed therein.

The recess 20 is formed into the vertical elongated side 24 of the rectangular extension wherein the recess is substantially in the shape of the triangularly-shaped sharpening blades 16*a* and 16*b*. In addition, the recess is configured to hold the sharpening blades 16*a* and 16*b* at a particular orientation (discussed below) best suited for the knife sharpening task. As shown in FIG. 3, the recesses and therefore the blades are such that they are orientated toward the center of the rectangular extension. The recess 20 is formed such that the triangularly-shaped blades 16*a* and 16*b* are angled inwardly for narrowing the sharpening groove 21 there-between. The guide groove 22 extends through the width of the rectangular extension from the recess 20 and extends through the body member in alignment with the sharpening groove 21 formed from the abutting blades. As such, both the sharpening groove 21 and the guidance groove 22 are substantially V-shaped for allowing the insertion of the knife 26 shown in FIG. 1.

Figure 7:
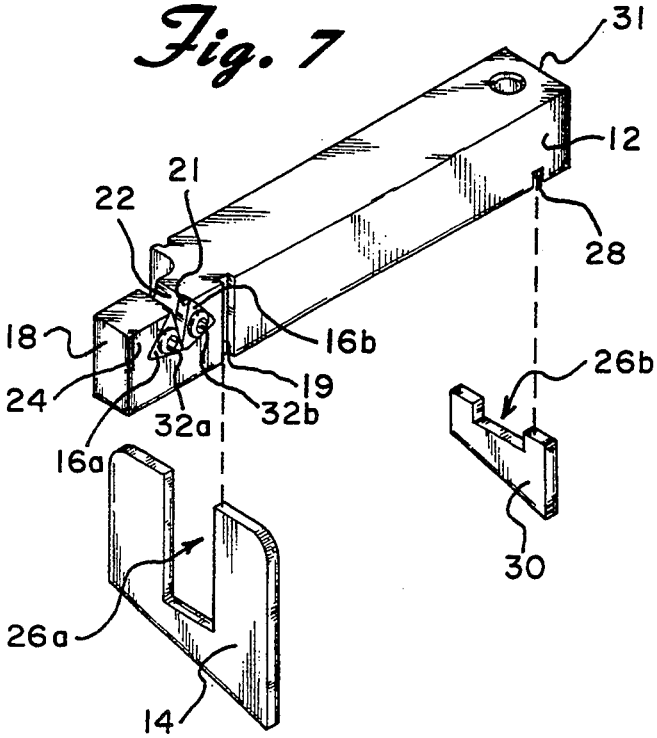
FIG. 7 is a perspective, exploded view showing the attachment of the support/guard members and an alternate shape of the same.
Figure 8:
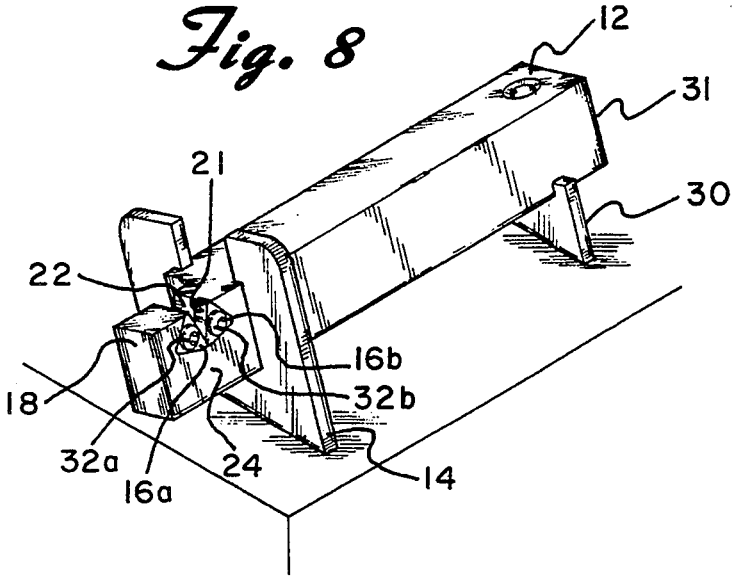
FIG. 8 is a perspective view of the sharpener on a table using the alternately-shaped support members.

The guide 14 is a substantially planar section of plastic or the like having a rectangular slot 26, shown in FIG. 7, for engagement with the groove 19 on the body member 12. FIG. 3 shows the support/guide having a horizontal bottom edge wherein FIG. 7 shows a second embodiment of the support/guide having an angled edge and also having a companion support 30 located adjacent the other end 31 of the body member 12 for engagement with the groove 28. The FIG. 7 or second embodiment causes the body member of the knife sharpener to be orientated at an angle to a horizontal table top as shown in FIG. 8. As such, while sharpening the knife, the knife can be held at a more comfortable and potentially safer angle for sharpening the same.

Referring now to FIGS. 3 through 6, the triangularly-shaped blades 16*a* and 16*b* are in the shape of equilateral triangles and are formed from a metallic material having excellent sharpening characteristics. The size of the sharpening blades is substantially equal to the size of the recess 20 so that the blades fit snugly therein. As shown in FIG. 3, the blades 16*a* and 16*b* are attached to the body member 12 and in the recesses 20 via use of screws 32*a* and 32*b*. Each of the blades 16*a* and 16*b* have a hole through the center thereof, 34*a* and 34*b*, respectively, for engagement with the screws 32*a* and 32*b*. The screws 32*a* and 32*b* are then screwed into the body member 10 within the recess 20 for securing the blades to the body member.

Figure 4:
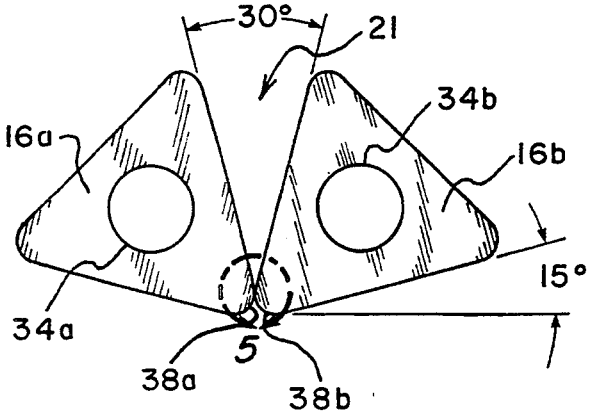
FIG. 4 is a schematic view of the blades showing their relative angular orientations and their rounded corners.
Figure 5:
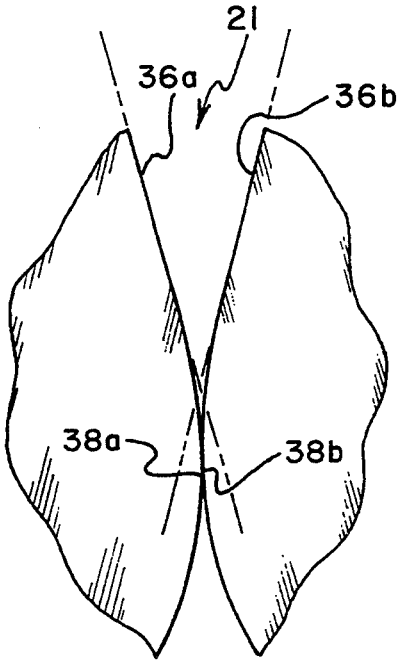
FIG. 5 is an enlarged view of the abutting blades taken along line 5 of FIG. 4 and showing the unique shape of the sharpening groove.
Figure 6:
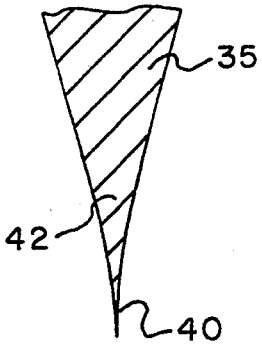
FIG. 6 is a cross-sectional view of a knife subsequent to being sharpened in the groove shown in FIG. 5.

Referring now to FIG. 4, unlike a normal triangle, the blades 16*a* and 16*b* have rounded corners or intersections. The preferred size of the radii is 1/32, however, the radii may range from 1/64 to 3/16. The purpose of the rounded corners is to form the shape of the knife edge as shown in FIG. 5. This shape resembles the shape of the groove 21 between the sharpening blades 16*a* and 16*b*. As shown in FIG. 5, the transition between the straight edges 36*a* and 36*b* into the rounded corners 38*a* and 38*b* form the unique shape of the sharpening groove 21 for the sharpener 10. As such and as shown in FIG. 6, a knife edge sharpened within the sharpening groove 21 takes on the shape of the sharpening groove 21. As can be seen in FIG. 6, the point 40 of the knife edge 35 and the section 42 leading into the point is very narrow. Accordingly, a very thin and sharp knife edge is formed which exhibits increased cutting ability.

In order to create the sharpening groove 21 and to obtain the shape of the knife edge 35, shown in FIG. 6, the sharpening blade 16*a* and 16*b* should be orientated as shown in FIG. 4 wherein the bottom edge of each blade is preferably at a 15° angle from the horizontal which causes a preferable 30° angle to be formed between the blades 16*a* and 16*b*. This particular orientation, as shown in FIG. 4, is established and stabilized by forming the recess 20 to a shape resembling the desired configuration. While the forgoing angles are preferred, it is believed that the groove angle may have a range of between 25° to 40° while the bottom edge angle may range, respectively, from 17½ to 10°.

The knife sharpener is used as shown in FIG. 1 wherein the sharpener is placed on a table or the like and the knife 26 is drawn through the sharpener groove 21. When the edges 36*a* and 36*b* become dull, the blades can be removed as shown in FIG. 3 and rotated or flipped over to expose a fresh edge. For safety purposes, if a second hand is being used to hold the knife sharpener down instead of it being permanently attached to a table, it is essential that the hand be placed behind the guard 14 so as to avoid any injury to the hands.

The present invention may be embodied in other specific forms without departing from the spirit or essential attributes thereof and accordingly reference should be made to the appended claims rather than to the foregoing specification as indicating the scope of the invention.

What is claimed is:

1. A knife sharpener comprising:

a body member;

means for angling said body member from the horizontal plane;

first and second sharpening blades attached to said body member;

said first and second blades positioned to form a sharpening groove therebetween, a portion of said first blade being located in the same plane as a portion of said second blade, said plane extending substantially perpendicular to said groove;

each of said blades having a plurality of intersecting sides forming a plurality of intersections, said intersections of each blade being substantially curvilinear in shape, said blades being positioned such that one intersection from said first blade substantially abuts an intersection from said second blade;

said sides and the curvilinear shape of said abutting intersections combining to form said groove for sharpening the edge of a knife, said groove being shaped and adapted to sharpen said edge into a beveled configuration in which both sides thereof are partially formed into the curvilinear shape of said intersection, and a guard means including a detachable leg member attached to said body member for separating said knife sharpening blades and said knife from the remaining portion of said body member.

2. The invention according to claim 1 wherein said groove is comprised of a side from said first blade being arranged to confront a side of said second blade, said sides extending downwardly on an angle and intersecting at said abutting intersections, said intersections abutting at points along an inwardly extending portion of said curvilinear shape.

3. The invention according to claim 2 wherein said intersections are rounded having substantially equivalently-sized radii.

4. The invention according to claim 1 further comprising a support member comprising a detachable leg member having means for connection to said body member, said angling means comprising said guard means and support member having an angled bottom surface for elevating said body member on an angle for easier insertion of said knife.

5. The invention according to claim 4 wherein said connection means comprises slots cut into said leg members adapted to engage mating slots cut into said body member.

6. A knife sharpener comprising:

a substantially elongated rectangular block and first and second sharpening blades attached to said block, said first and second sharpening blades being substantially triangular in shape;

said first and second blades positioned to form a sharpening groove therebetween, a portion of said first blade being located in the same plane as a portion of said second blade, said plane extending substantially perpendicular to said groove;

each of said blades having a plurality of intersecting sides forming a plurality of intersections, said intersections of each blade being substantially curvilinear in shape, said blades being positioned such that one intersection from said first blade substantially abuts an intersection from said second blade;

said sides and the curvilinear shape of said abutting intersections combining to form said groove for sharpening the edge of a knife, said groove being shaped and adapted to sharpen said edge into a beveled configuration in which both sides thereof are partially formed into the curvilinear shape of said intersection;

said blades having three intersections with said curvilinear shape and having a plurality of sharpening edges on each side of said blade;

said block having recesses formed therein for engagement with said blades, said recesses being formed in the shape of said blades and being located on said block adjacent an insertion groove formed through said block for alignment with said sharpening groove.

7. The invention according to claim 6 wherein said blades are detachably and rotatably secured to said block such that they are adapted to be manipulated thereon for exposing a fresh sharpening surface.

8. A knife sharpening blade comprising a plurality of intersecting sides having sharpening edges thereon, said sides forming a plurality of intersections wherein said intersections are substantially rounded in shape having substantially equivalently-sized radii and wherein said blade is substantially triangular in shape.

* * * * *